US012790922B1

(12) United States Patent
Al Sulaiman et al.

(10) Patent No.: US 12,790,922 B1
(45) Date of Patent: Nov. 10, 2026

(54) PRESSURE AND VOIDAGE-BASED MATERIAL BALANCE MODELS FOR IMPROVED HYDROCARBON RECOVERY FROM INJECTION WELLS

(71) Applicant: Saudi Arabian Oil Company, Dhahran (SA)

(72) Inventors: Ahmed A. Al Sulaiman, Dhahran (SA); Ahmed Wagia Alla, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/394,330

(22) Filed: Nov. 19, 2025

(51) Int. Cl.
*E21B 47/06* (2012.01)
*E21B 43/12* (2006.01)
*E21B 47/003* (2012.01)

(52) U.S. Cl.
CPC ..... *E21B 43/121* (2013.01); *E21B 47/003* (2020.05); *E21B 47/06* (2013.01)

(58) Field of Classification Search
CPC ..... E21B 43/20; E21B 43/25; E21B 47/003; E21B 47/06
See application file for complete search history.

(56) References Cited

U.S. PATENT DOCUMENTS 6,128,579 A 10/2000 McCormack et al.
10,726,173 B2 7/2020 Thiele et al.
11,913,333 B2 2/2024 Al-Shahri et al.
11,927,084 B2 * 3/2024 Azom ..... C09K 8/592
12,590,529 B2 * 3/2026 Noufal ..... E21B 47/0025
2012/0158310 A1 * 6/2012 Adams ..... E21B 47/06 702/12
2013/0312958 A1 * 11/2013 Denyer ..... E21B 43/16 166/67
2021/0225070 A1 * 7/2021 Al-Nasser ..... G01V 20/00
2022/0307358 A1 * 9/2022 MacPhail ..... E21B 17/1035
2024/0344447 A1 * 10/2024 Sankaran ..... E21B 47/06

OTHER PUBLICATIONS

Al-Marhoun, "The Oil Compressibility Below Bubble Point Pressure Revisited-Formulations and Estimations," Paper presented at the SPE Middle East Oil and Gas Show and Conference, Manama, Bahrain, Mar. 2009, Abstract Only, 2 pages.

(Continued)

*Primary Examiner* — Shane Bomar
(74) *Attorney, Agent, or Firm* — Fish & Richardson P.C.

(57) ABSTRACT

Systems and methods for oil production from a reservoir include determining a cumulative oil production of a reservoir, a cumulative water production of the reservoir, and a cumulative injection volume of water. A cumulative injection-to-production ratio of the reservoir and a normalized reservoir pressure of the reservoir are determined. An injection efficiency of the reservoir is determined based on a comparison between the cumulative injection-to-production ratio and the normalized reservoir pressure. And in response to determining that the injection efficiency is below a threshold, an injected fluid volume in the reservoir or an aquifer influx of water into the reservoir is adjusted to increase the injection efficiency of oil production of the reservoir based on a difference between the cumulative injection-to-production ratio and the normalized reservoir pressure.

20 Claims, 10 Drawing Sheets

(56) References Cited

OTHER PUBLICATIONS

Qiu et al., "Improved Flow Material Balance Equation for Dynamic Reserve Calculation Considering Variable Gas Drainage Radius in Shale Gas Reservoirs," SPE J., Jul. 10, 2024, 29(07):3844-3858, Abstract Only, 2 pages.
Sharifov et al., "New approaches to oil production management based on solving the material balance equation for waterflooding blocks (Russian)," OIJ 2022, Dec. 1, 2022 (12):100-104, Abstract Only, 2 pages.

* cited by examiner

PRESSURE AND VOIDAGE-BASED MATERIAL BALANCE MODELS FOR IMPROVED HYDROCARBON RECOVERY FROM INJECTION WELLS

TECHNICAL FIELD

The present disclosure describes systems and methods for hydrocarbon recovery, and more particularly, systems and methods that improve injection efficiency of a hydrocarbon reservoir by controlling injection wells to pump fluid into the reservoir based on pressure and voidage-based material balance models for a subsurface reservoir.

BACKGROUND

Material balance models of reservoirs can be used to assist with hydrocarbon recovery from reservoirs. However, obtaining the necessary inputs for material balance models can be time consuming and difficult. In addition, the output of the material balance models needs to be validated and verified, which can be difficult when the input data and validation data are limited, and/or when project timelines are constrained.

SUMMARY

The disclosed systems and methods can increase hydrocarbon production by providing a streamlined solution for generating analytical material balance models while mitigating complexities associated with traditional approaches. By leveraging dynamic data, formation volume factors, and initial reservoir conditions, the disclosed systems and method deliver significant actionable insights. Important benefits include reduced requirements for extensive data volumes, varied datasets, and specialized expertise, ultimately saving time and resources. Furthermore, the model yields both qualitative and quantitative assessments of effective external injection and aquifer support to increase the injection efficiency of reservoirs.

In reservoir engineering, material balance calculations play an important role in understanding the dynamic behavior of oil-water two-phase reservoirs. By applying the principles of conservation of mass, energy, and momentum, material balance models provide valuable insights into the reservoir's response to production and injection operations. Some important applications of material balance calculations include estimating original hydrocarbon volume-in-place (OHIP), assessing aquifer support, evaluating external injection, and calibrating and validating history matching studies.

By leveraging material balance calculations and integrating them with other disciplines, such as geology, petrophysics, and simulation, reservoir engineers develop a holistic understanding of the subsurface environment. This allows for informed decision-making throughout the entire lifecycle of a project—from exploration and appraisal to development and eventual abandonment.

To achieve these objectives, engineers employ sophisticated software tools (e.g., MBAL, Eclipse, CMG Suite, etc.) to construct and analyze material balance models. The models of these software tools account for various complexities, including non-linear relationships between variables, heterogeneities in reservoir properties, and coupled processes occurring across multiple phases. The model construction requires large amounts of data and diverse data including rock properties, fluid properties, geology (pore volume), initial reservoir conditions, production history, injection history, and reservoir pressure data. In some cases, the data includes aquifer model parameters and well completions. Having access to this data is important to create a reasonably accurate material balance model. However, some assumptions might still need to be made if certain data is missing or is unreliable introducing more uncertainties to the model results.

The systems and methods described in this disclosure can provide one or more of the following benefits and/or advantages: (i) reduced complexity: simplify modeling processes minimizing construction complexity to assess effective injection volume and or aquifer support influxes; (ii) lower data requirements: lower demands for extensive data volumes and varied datasets reduce the burden on data collection and management; (iii) time savings: reduced data collection, preparation, and validation efforts, fewer iterative cycles required to achieve convergence, straightforward model setup and calibration streamline workflows, and faster interpretation of complex output enables swift decision-making; (iv) lower expertise barrier: less reliance on specialized knowledge and data management skills make the model more accessible to a broader range of users; (v) actionable insights: qualitative and quantitative estimates of effective external injection and aquifer support inform strategic decisions; (vi) improved decision making: accurate and reliable predictions empower confident decision-making (such as determining pump schedules); (vii) increased efficiency: a streamlined workflow accelerates reservoir performance evaluation and optimization; (viii) unlock new opportunities: leverage model results to explore new development optimization possibilities, optimize injected water volumes based on estimated effective external injection and/or aquifer influx, driving business growth; (ix) robust history matching: improve accuracy of predictive forecasts by integrating the material balance model with simulation studies for enhanced history matching of dynamic data; and (x) optimize operating cost by optimizing injected water volume in lights of the model results.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The disclosed systems and methods can increase hydrocarbon production by providing a streamlined solution for generating analytical material balance models while mitigating complexities associated with traditional approaches. By leveraging dynamic data, formation volume factors, and initial reservoir conditions, the disclosed systems and method deliver significant actionable insights. Important benefits include reduced requirements for extensive data volumes, varied datasets, and specialized expertise, ultimately saving time and resources. Furthermore, the model yields both qualitative and quantitative assessments of effective external injection and aquifer support to increase the injection efficiency of reservoirs.

Figure 1:
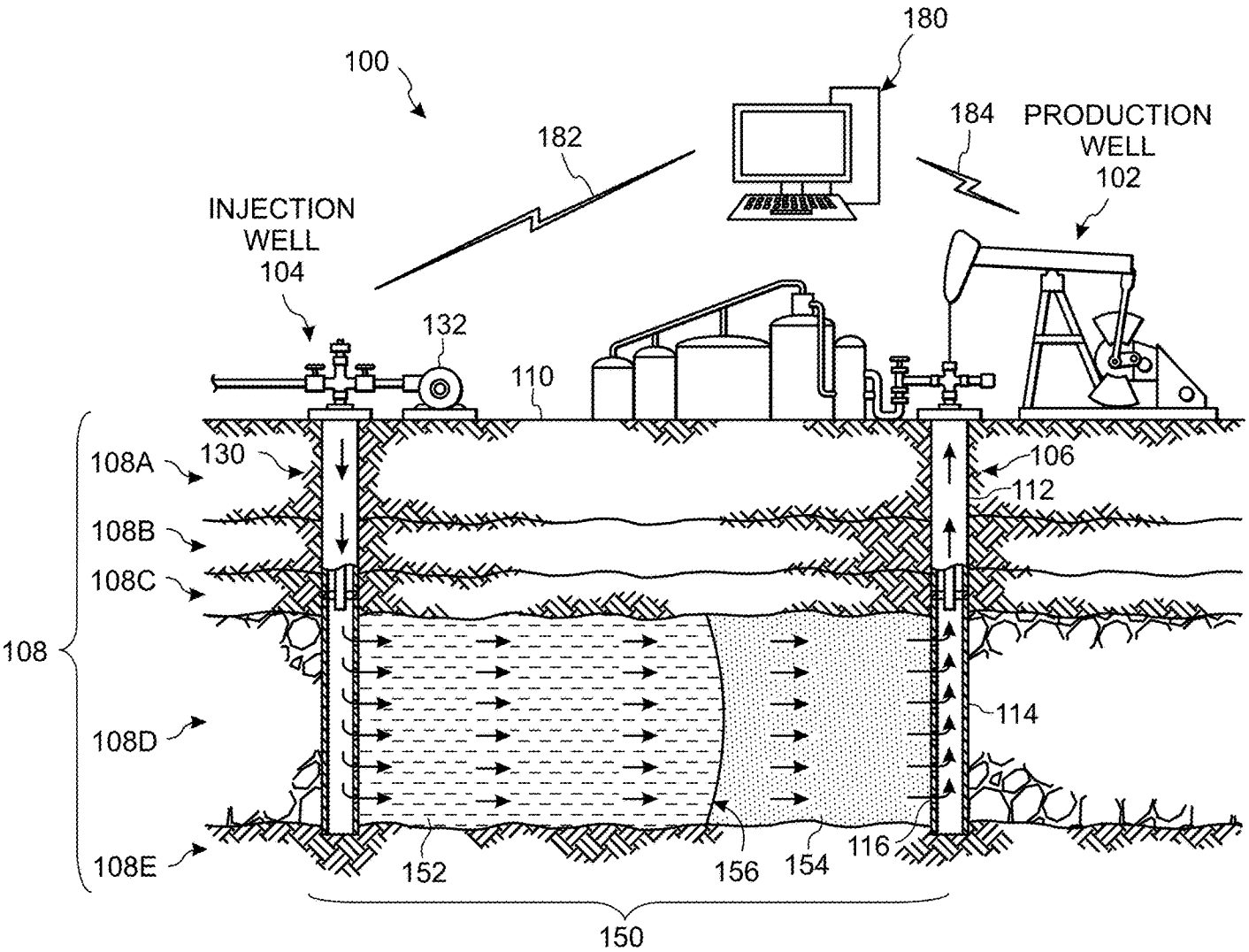
FIG. 1 is a schematic diagram of an example wellbore system.

FIG. 1 is a schematic diagram of wellbore system 100 that includes a production well 102 and an injection well 104. The production well 102 includes a vertical wellbore 106 formed into a subterranean formation 108. In some examples, the wellbore 106 is formed by drilling into one or more layers of the subterranean formation 108. In this example, the wellbore 106 extends through four layers 108A-D and lands in subterranean layer 108E. In this example, a reservoir 150 of hydrocarbon 154 (e.g., oil) is located within subterranean layer 108D. The reservoir 150 includes porous shale rock with pores that contain the hydrocarbon 154 and/or sandstone with the hydrocarbon 154 located between the grains of the sandstone.

The production well 102 includes a production casing 114 formed downhole of a surface casing 112. In some examples, both the surface casing 112 and the production casing 114 are formed and set within the wellbore 106 by pouring cement between each respective casing 112, 114, and the subterranean layers 108A-E. The production casing 114 includes one or more perforations 116 that allow the hydrocarbon 152 to flow from the reservoir 150 into the wellbore 106 and up to the ground surface 110.

The injection well 104 includes a wellbore 130 that is generally the same as the wellbore 106 of the production well 102 except for the following differences. The injection well 104 includes a pump 132 that pumps a displacing fluid 152 (e.g., water) into the reservoir 150. In some examples, the injection of the fluid 152 increases a recovery of the hydrocarbon 154 from the reservoir 150 because the fluid 152 forces the hydrocarbon 154 through the porous shale and sandstone rock to the production well 102. The region where the fluid 152 and the hydrocarbon 154 interact is represented by region 156. In some examples, the process of injecting water 152 into the reservoir 150 for this purpose is referred to as "waterflooding."

The wellbore system 100 includes a computer system 180 in wired or wireless communication 182, 184 with the production well 102 and/or the injection well 104. In some implementations, the computer system 180 is in wired or wireless communication 182 with the pump 132 at the injection well 104. In some implementations, the computer system 180 is in wired or wireless communication 184 with a pump at the production well 102.

The computer system 180 includes one or more processors configured to execute computer code and one or more controllers configured to send control signals to the pump 132 at the injection well 104 and/or the pump at the production well 102. Further details about the computer system 180 are described with reference to FIG. 10.

In some implementations, the computer system 180 stores and executes a material balance model representing oil zone oil expansion+gas zone gas expansion oil zone and gas zone pore volume and connate water expansion+water influx+water injected+gas injected=oil produced+gas produced+water produced.

In some implementations, the material balance model is represented in equation form as follows:

$$N(B_t - B_{ti}) + G(B_g - B_{gi}) + (NB_{ti} + GB_{gi})\left(\frac{C_f + C_w S_{wi}}{1 - S_{wi}}\right)\Delta p_t + W_e + W_I B_{Iw} + G_I B_{Ig} = N_p B_t + N_p(R_p - R_{soi})B_g + W_p B_w \quad \text{(Equation 1)}$$

where:

| Symbol | Definition |
|---|---|
| $N$ | initial oil in place, stock tank barrel (STB) |
| $N_p$ | cumulative oil produced, STB |
| $G$ | initial gas in place, standard cubic foot (SCF) |
| $G_i$ | cumulative gas injected into reservoir, SCF |
| $G_p$ | cumulative gas produced, SCF |
| $W_e$ | water influx into reservoir, barrel (bbl) |
| $W_i$ | cumulative water injected into reservoir, STB |
| $W_p$ | cumulative water produced, STB |
| $B_{t_i}$ | initial two-phase formation volume factor, bbl/STB = $B_{oi}$ |
| $B_{oi}$ | initial oil formation volume factor, bbl/STB |
| $B_{gi}$ | initial gas formation volume factor, bbl/SCF |
| $B_t$ | two-phase formation volume factor, bbl/STB = $B_o + (R_{soi} - R_{so})B_g$ |
| $B_o$ | oil formation volume factor, bbl/STB |
| $B_g$ | gas formation volume factor, bbl/SCF |
| $B_w$ | water formation volume factor, bbl/STB |
| $B_{gi}$ | injected gas formation volume factor, bbl/SCF |
| $B_{wi}$ | injected water formation volume factor, bbl/STP |
| $R_{soi}$ | initial solution gas-oil ratio, SCF/STP |
| $R_{so}$ | solution gas-oil ratio, SCF/STP |
| $R_p$ | cumulative produced gas-oil ratio, SCF/STP |
| $C_f$ | formation compressibility, $psia^{-1}$ |
| $C_w$ | water isothermal compressibility, $psia^{-1}$ |
| $S_{wi}$ | initial water saturation |
| $\Delta p_t$ | reservoir pressure drop, psia = $p_i - p(t)$ |
| $p(t)$ | current reservoir pressure, psia |

In some implementations, the systems and methods do not apply equation 1, at least not directly. Instead, the systems and method offer an alternative approach relating to reservoir pressure response and cumulative IPR that simplifies the construction of material balance and compute fluxes without applying equation 1 directly. This approach enables more efficient and streamlined analysis, whereas equation 1 is typically deployed in sophisticated software tools, such as MBAL, Eclipse, and CMG Suite, which require a large data size and diversity to construct and analyze material balance models and compute fluxes.

The systems and methods described in this disclosure target two-phase oil-water reservoirs characterized by initial undersaturation and sustained pressures above the bubble point pressure throughout production. This condition is typically maintained by strong aquifer support and/or external water injection (for example, by the injection well 104). Notably, the material balance model assumes no oil compressibility effect as the compressibility impact is minimal above the bubble point pressure. For context, the bubble point pressure represents the critical fluid property threshold where the first gas bubble emerges in a liquid hydrocarbon mixture at a specified temperature.

Figure 2:
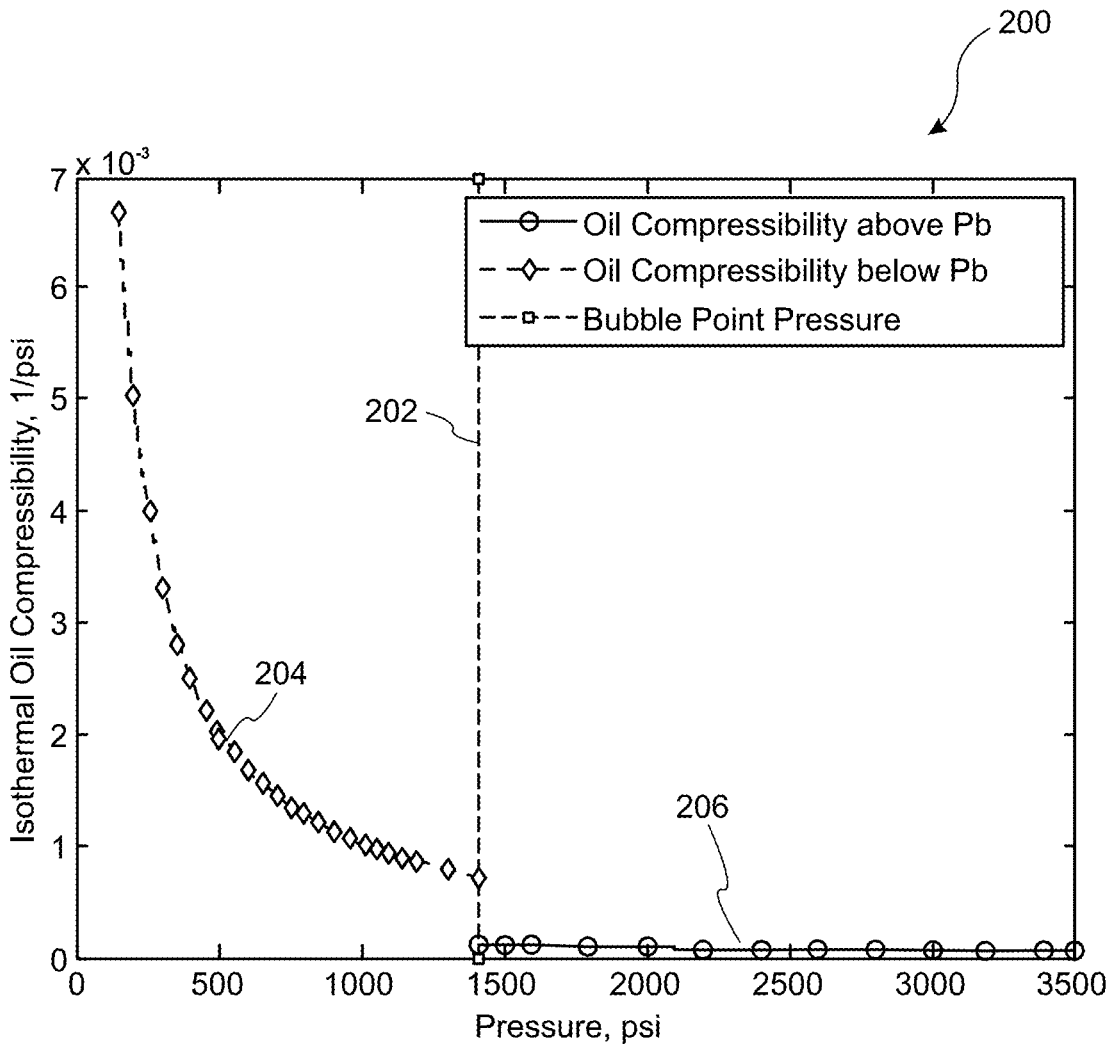
FIG. 2 is a plot of a typical oil compressibility curve.

FIG. 2 is a plot 200 of oil compressibility as a function of pressure (psi). The oil compressibility has units of reciprocal pressure (for example, reciprocal pounds per square inch (1/psi)). The bubble point pressure is indicated by a vertical line 202. The bubble point pressure is a fluid pressure at which the first bubble of gas appears in a liquid hydrocarbon mixture at a given temperature. At a given temperature, fluid properties—particularly oil compressibility—exhibit significant variations when falling below the bubble point pressure (see segment 204), whereas changes above this threshold are relatively negligible (see segment 206).

The material balance model is constructed using production and injection history and initial reservoir conditions data. Thus, the solution of the material balance model applies to two phase oil and water reservoirs that are initially undersaturated and pressure continues to remain above the bubble point pressure during production by strong aquifers support and/or external water injection. The material balance model also applies to light oil and the change in fluid properties above the bubble point pressure is minimal and/or can be negligible.

In some implementations, the material balance model receives one or more of the following data as input: (i) production data of a production well 102 (for example, oil and water volumes); (ii) external injection data (for example, injection volume from injection well 104); (iii) reservoir pressure shut-in surveys data with time; (iv) initial reservoir pressure prior production and injection activities; and (v) fluid property of oil formation volume factor ($B_o$) at initial reservoir pressure and temperature (obtained from PVT lab studies). In some implementations, the material balance model receives all of the data indicated in this paragraph as input.

In some implementations, the computer system 180 executes the material balance model using the following process. First, the cumulative oil production barrels at reservoir conditions is determined. In some implementations, this involves multiplying the oil volume at standard surface conditions by $B_o$. Next, the cumulative water production barrels at reservoir conditions is determined. In some examples, the volume at reservoir conditions and surface conditions is almost same, otherwise $B_w$ is applied. Next, the cumulative external injection water barrels at reservoir conditions is determined. In some examples, the volume at reservoir conditions and surface conditions is almost same, otherwise $B_w$ is applied. Next, the cumulative injection-to-production Ratio ($IPR_{cum}$) as a function of time is determined based on the following equation:

$$IPR_{cum} = \frac{Qinj_t \times B_w}{(Qo_t \times B_O) + ((Qw_t \times B_w)} \quad \text{(Equation 2)}$$

where:

| Symbol | Definition |
|---|---|
| $Qinj_t$ | Cumulative injection in standards surface barrels at a given time |
| $Qo_t$ | Cumulative oil production in standards surface barrels at a given time |
| $Qw_t$ | Cumulative produced water in standards surface barrels at a given time |

-continued

| Symbol | Definition |
|---|---|
| $B_o$ | Oil formation volume factor at initial reservoir pressure and temperature conditions |
| $B_w$ | Water formation volume factor at initial reservoir pressure and temperature conditions |

Next, the reservoir pressure survey data is normalized using the following equation:

$$\text{Normalized Pressure} = \frac{P_t - P_{lowest}}{P_{initial} - P_{lowest}} \quad \text{(Equation 3)}$$

where:

| Symbol | Definition |
|---|---|
| $P_t$ | Variable pressure with time for a given region |
| $P_{lowest}$ | Lowest pressure ever reached throughout history for a given region |
| $P_{initial}$ | Initial reservoir pressure prior any depletion or injection activities |

Figure 3:
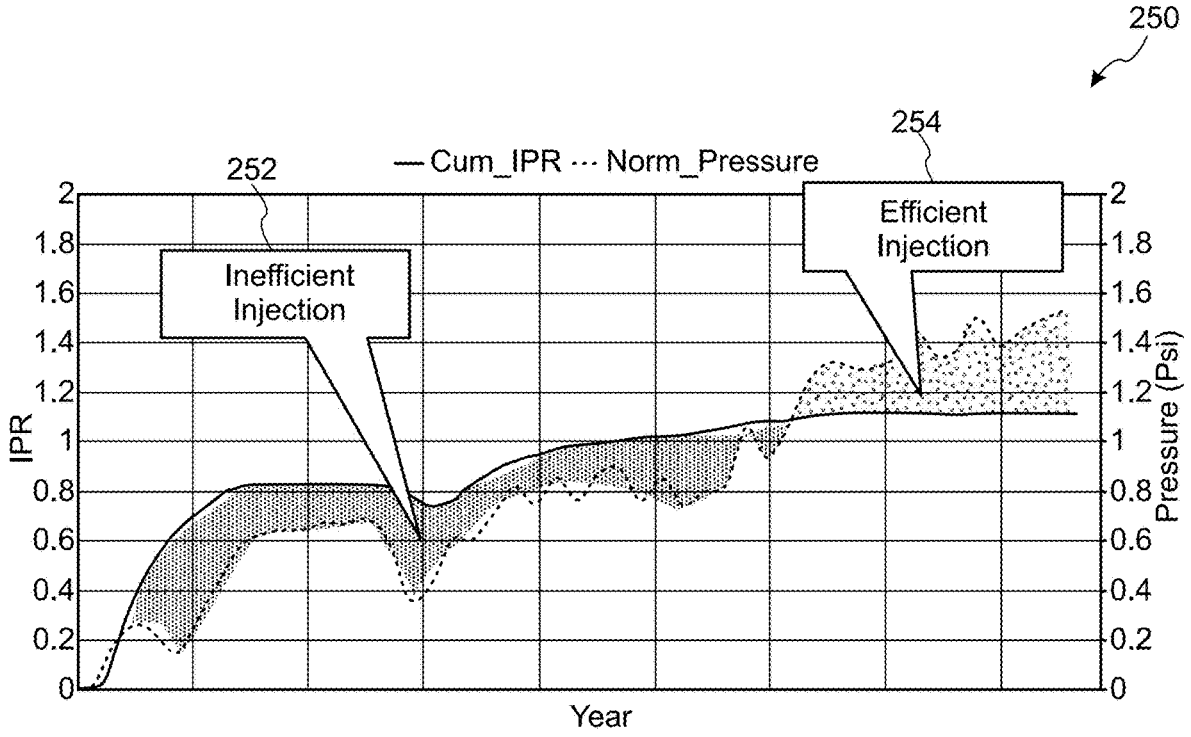
FIG. 3 is a plot of a normalized reservoir pressure profile versus a cumulative injection-to-production ratio ($IPR_{cum}$) response curve over time.

FIG. 3 is a plot 250 showing the $IPR_{cum}$ curve and the normalized pressure curve on the same scale as a function of time in years, allowing direct comparison to estimate effective injection volume and/or gains from aquifer support over time. $IPR_{cum}$ ranges from 0 (no injection) to 1 (complete replacement of produced fluids by injected water). If $IPR_{cum}$ exceeds 1, it means that water is being added beyond voidage replacement, which should result in boosting pressures above the initial conditions. Meanwhile, the normalized pressure curve exhibits three distinct zones: zero represents the minimum pressure recorded during the reservoir's lifetime; one indicates recovery of the initial reservoir pressure; and values greater than one signify overpressure due to sustained injection.

The material balance model provides qualitative assessment of injection effectiveness and aquifer support by accounting for the relationship between the normalized pressure curve and the $IPR_{cum}$ curve. In some implementations, the computer system 180 determines one or more of the following results based on the relationship between the normalized pressure curve and the $IPR_{cum}$ curve. In some implementations, when the normalized pressure curve is below the $IPR_{cum}$ curve (portion 252), it can indicate injection inefficiencies, losses, or weak aquifer support. In some implementations, when the normalized pressure curve is above the $IPR_{cum}$ curve (portion 254), it can suggest an increased injection efficiency or gains by active aquifers. In some implementations, the magnitude of the gap between the $IPR_{cum}$ curve and the normalized pressure curve can be indicative of the amount of injected water that is effectively displacing hydrocarbons versus being lost or inefficiently utilized. Thus, when the normalized pressure curve is above the $IPR_{cum}$ curve (portion 254), a greater gap (measured in the vertical direction) on the plot can be indicative of a greater efficiency. For example, a maximum efficiency shown in FIG. 3 is at the right-most side of the plot 250.

Qualitative Evaluation of Injection Efficiency and Aquifer Gains

Figure 4:
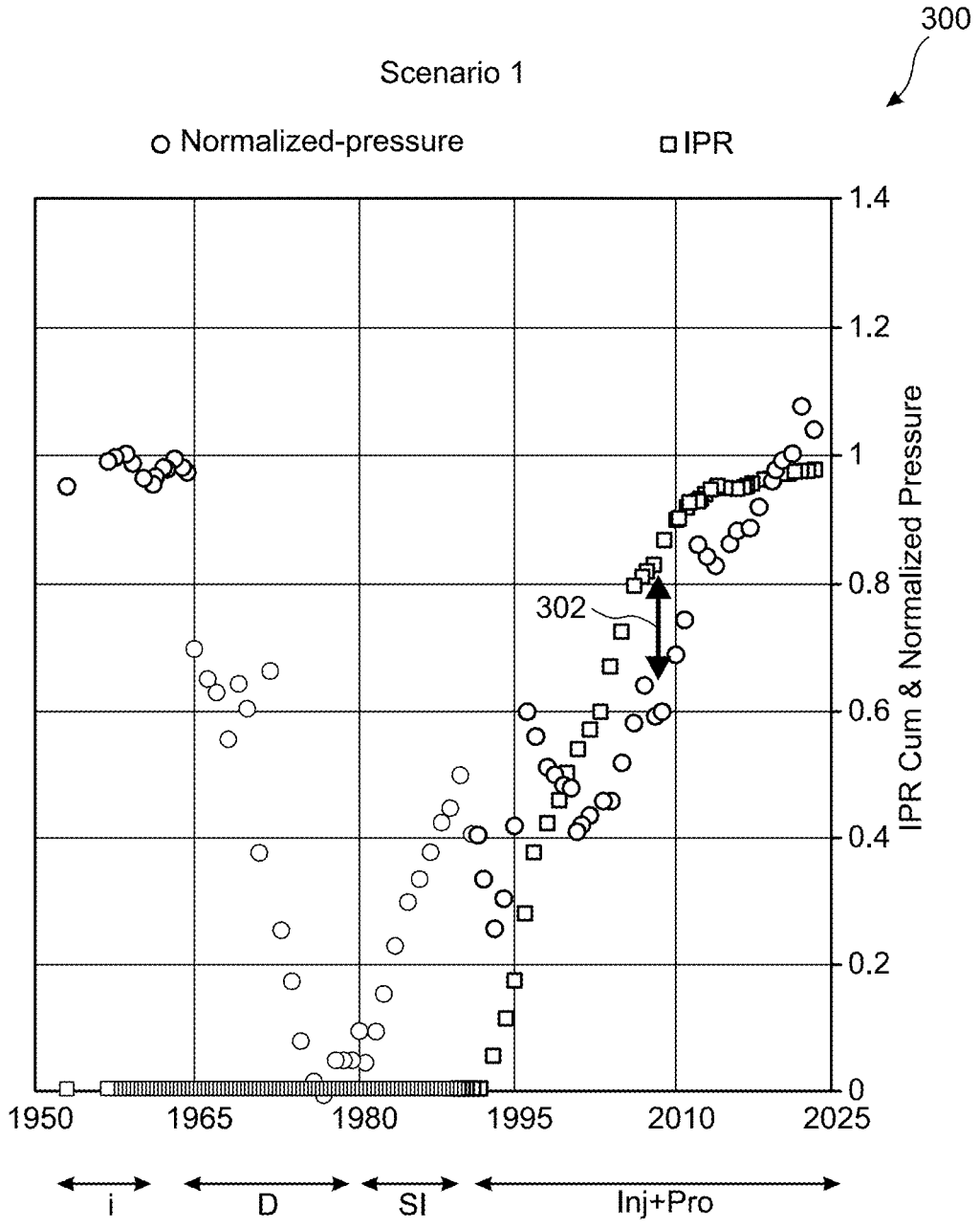
FIG. 4 is a plot of a first scenario showing high efficiency with minimal curve separation.
Figure 5:
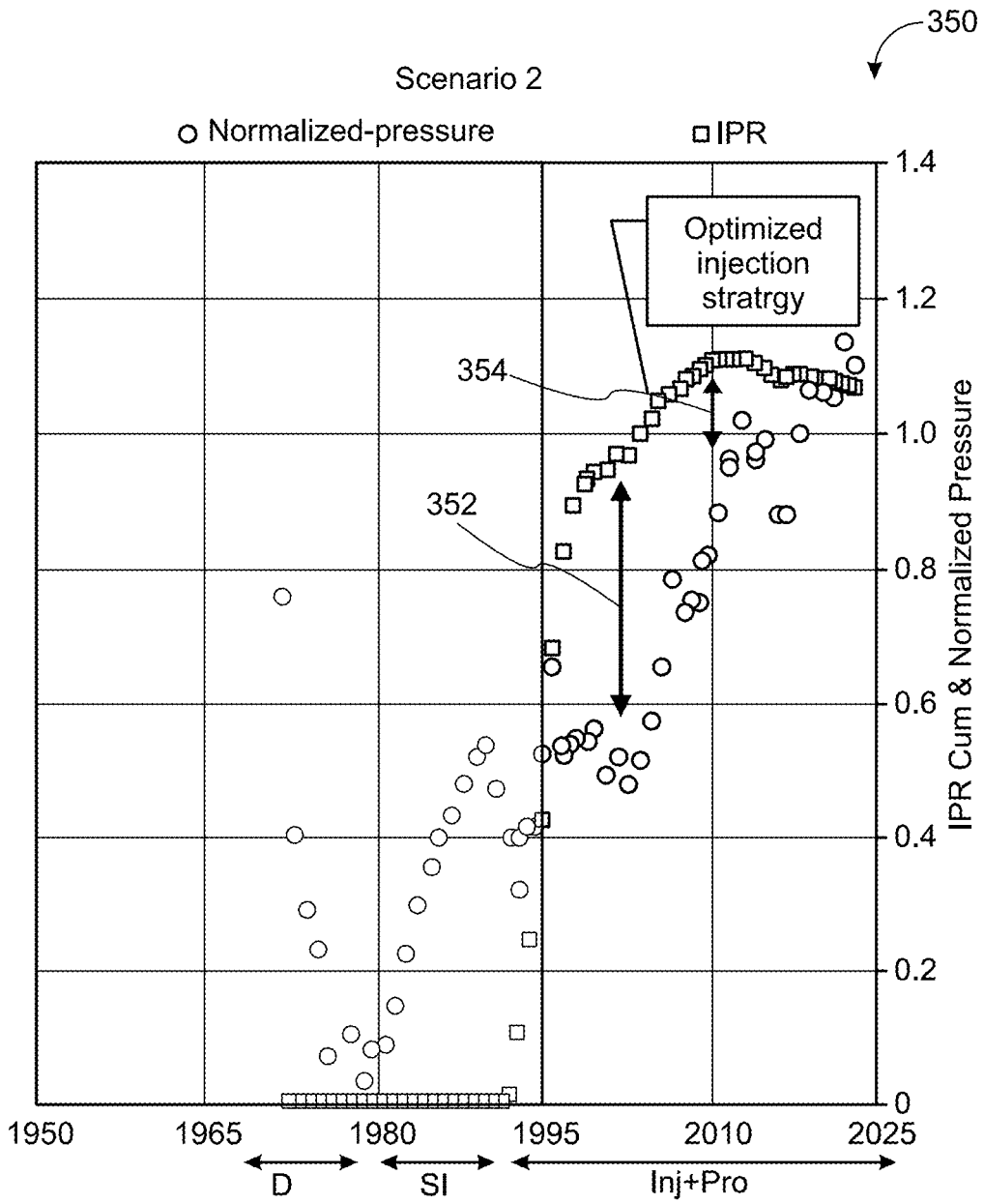
FIG. 5 is a plot of a second scenario that starts with low efficiency (large curve gap) before increasing efficiency to achieve notable improvements.
Figure 6:
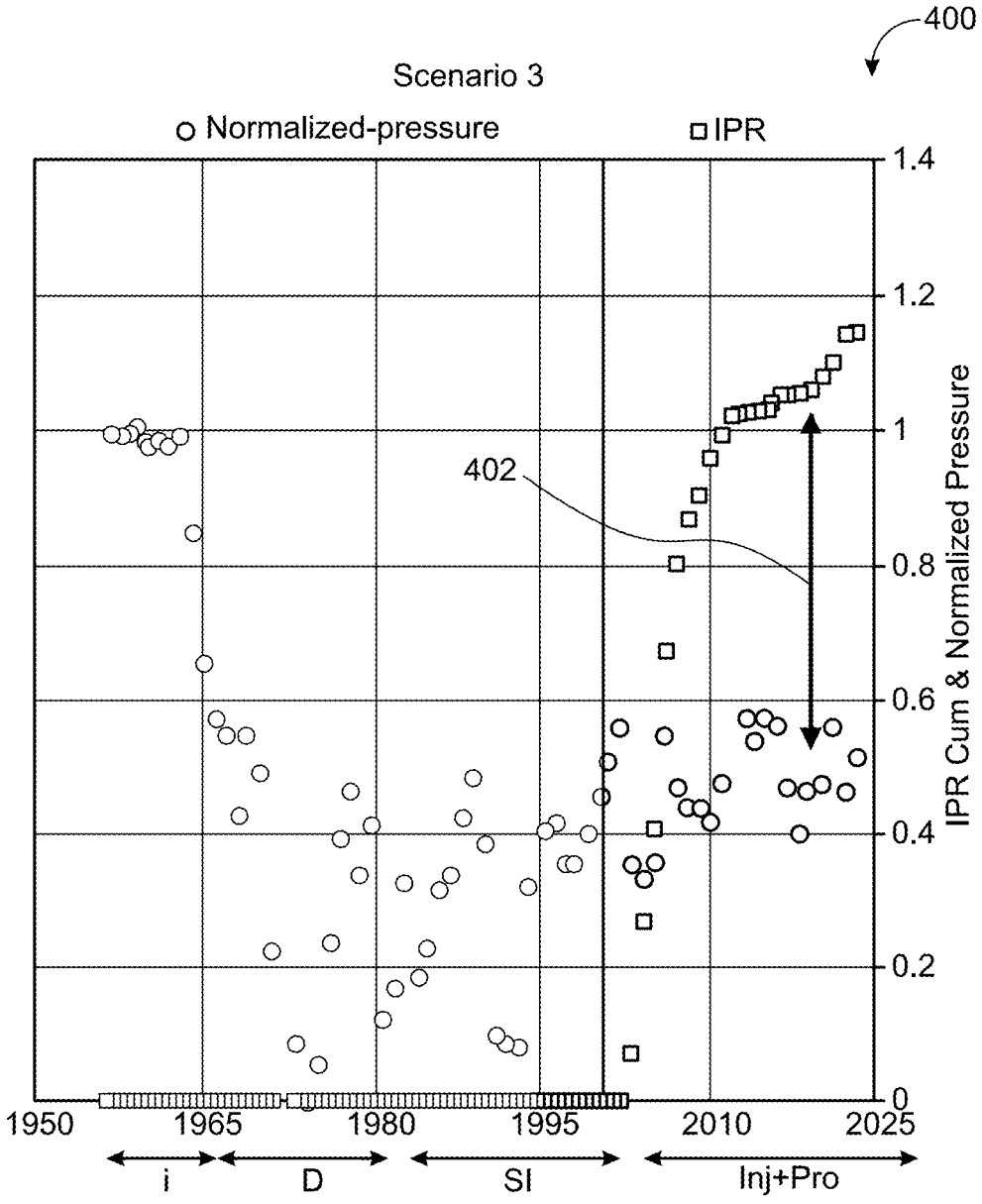
FIG. 6 is a plot of a third scenario revealing persistently poor injection efficiency throughout, with no notable improvement over time, thereby identifying areas for increasing efficiency.

FIGS. 4-6 are plots 300, 350, and 400, respectively, of different scenarios of the material balance model. The scenarios focus on the seawater injection period (e.g., 1992 onward). In the plots, "i" represents a time period in which the reservoir is at an initial reservoir pressure prior to any depletion, "D" represents a time period in which the reservoir is experiencing a first depletion not supported by injection, "SI" represents a time period in which the reservoir is experiencing field shut-in, and "Inj+Pro" represents a time period in which the reservoir is experiencing production and injection start up. The results are summarized for each scenario as follows.

FIG. 4 is a plot 300 of scenario 1 indicating a high injection efficiency. The computer system 180 generates the plot 300 from the material balance model results. In this scenario, a narrow gap between $IPR_{cum}$ and normalized pressure curves in the Inj+Pro period (see gap 302) indicates a rapid pressure response to injection. Despite incomplete voidage replacement, the initial reservoir pressure has already been restored. For example, compare the right-most result (at year 2025) to the left-most result (at year 1950). This behavior is characteristic of fractured reservoirs, where active fractures assist the transmissibility and promote pressure propagation causing oil lagging in the matrix system. In cases without identified fractures, similar behavior may suggest gains from an active aquifer. Scenario 1 exhibits extremely high injection efficiency (>90%).

FIG. 5 is a plot 350 of scenario 2 indicating an improved injection efficiency with time. The computer system 180 generates the plot 350 from the material balance model results. In this scenario, the material balance model reveals initially poor injection efficiency, evident from a wider gap between $IPR_{cum}$ and normalized pressure curves (see gap 352), compared to Scenario 1. Following the implementation of improved injection strategy, the gap narrows substantially, indicating a notable enhancement in injection efficiency at gap 354. If no strategic improvements had been made, similar behavior could potentially indicate gains from an active aquifer, possibly due to injection occurring within the aquifer in adjacent fields or reservoirs. Scenario 2 displays an upward trend, starting poorly (~40%) but improving significantly with the adapting an enhanced injection strategy.

FIG. 6 is a plot 400 of scenario 3 indicating optimization opportunities. The computer system 180 generates the plot 450 from the material balance model results. In this scenario, the material balance model reveals poor injection efficiency (see gap 402) without any improving trend unlike scenario 2. The results display the widest gap between the $IPR_{cum}$ and normalized pressure curves among scenarios 1-3. Unlike scenarios 1 and 2, the large gap persists without noticeable improvement, identifying injection strategy optimization opportunity similar to that for scenario 2. Scenario 3 shows persistently poor injection efficiency, averaging around 48-50% without an improving trend.

Quantitative Evaluation of Injection Efficiency and Aquifer Gains

Figure 7:
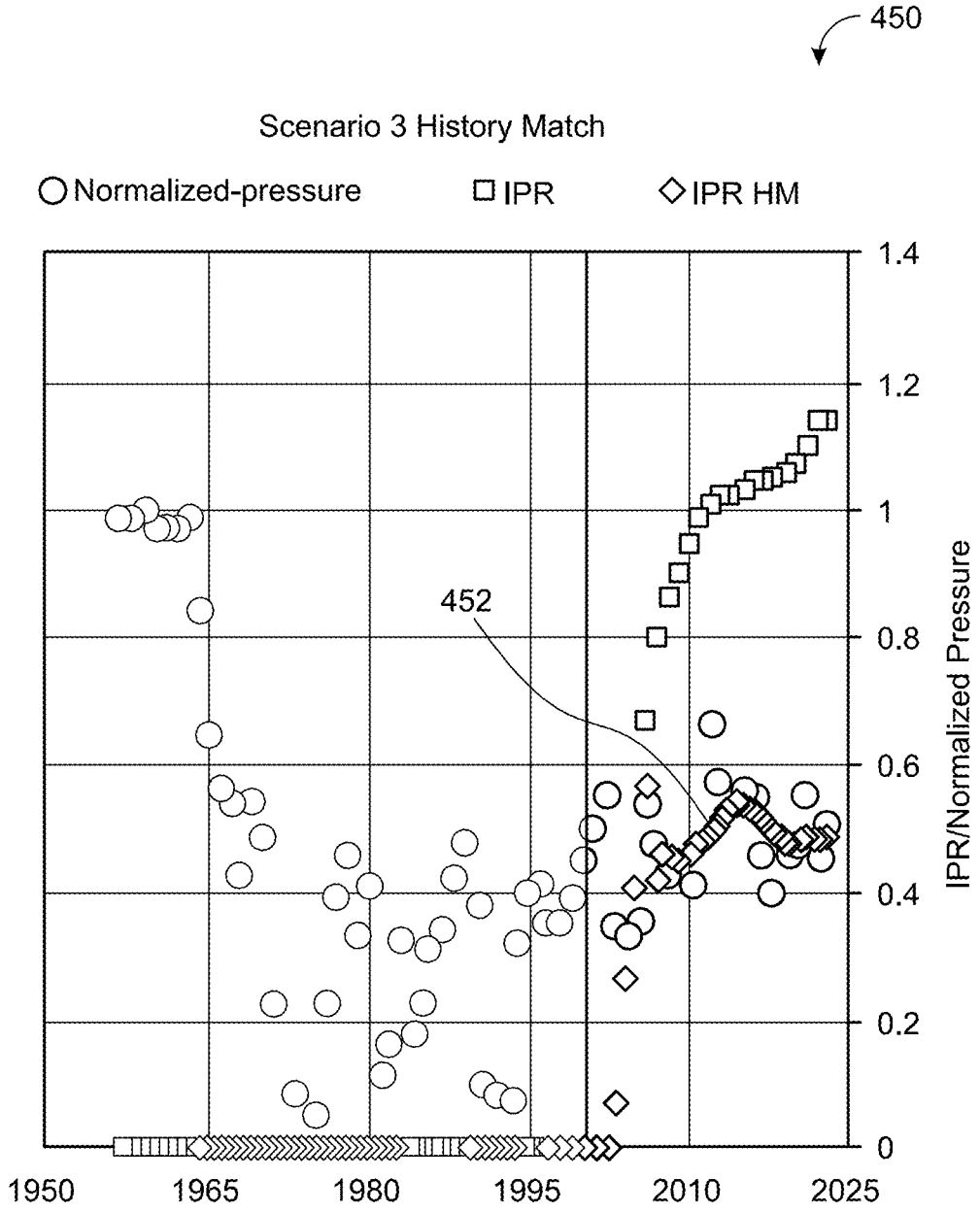
FIG. 7 is a plot showing an alignment of cumulative injection-to-production ratio to normalized pressure via history matching.

FIG. 7 is a plot 450 showing quantitative estimates of injection efficiency and aquifer contributions across the three scenarios (scenarios 1-3 of plots 300, 350, 400, respectively). The computer system 180 generates the plot 450 from the material balance model results. The computer system 180 applies a history match (HM) process by adding multipliers to the injected water volume or expected aquifer influxes until the $IPR_{cum}$ curve aligns with the normalized pressure curve. The history match result 452 is superimposed on normalized pressure and $IPR_{cum}$ curve as shown in FIG. 7. With the history match result 452, the computer system 180 can generate a comprehensive chart summarizing the behavior for each of the three scenarios. In some examples, the computer system 180 makes informed decisions for reservoir development strategies based on the history match result 452. The outcomes in these scenarios demonstrate strong agreement with actual field performance, confirming the reliability and applicability of the material balance model. In some implementations, the multiplier is not limited to a single value (e.g., the multiplier can be a plurality of values). For example, depending on the behavior of the IPR curve with respect to normalized pressure, multiple multipliers can be used to accurately represent the reservoir's performance. Also, the injection efficiency can mathematically be defined by the equation:

$$\text{Injection Efficiency} = 100 * \left(\frac{IPR_{cum}(t) - P_n(t)}{IPR_{cum}(t)}\right)$$

where $IPR_{cum}(t)$ is the cumulative IPR for a given time, and $P_n(t)$ is the instantaneous normalized pressure for a given time.

Figure 8:
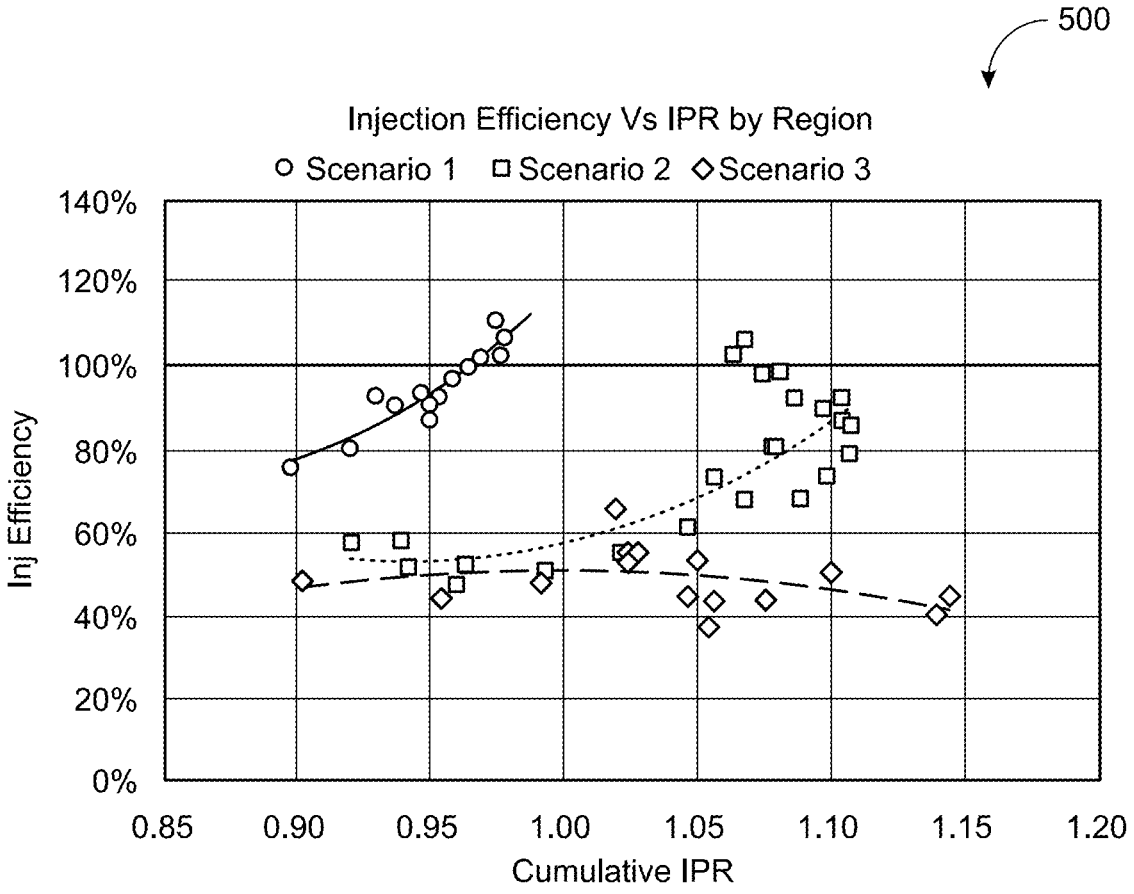
FIG. 8 is a plot showing trendlines of injection efficiency.

FIG. 8 is a plot 500 of injection efficiency versus $IPR_{cum}$ for the three scenarios (scenarios 1-3 of plots 300, 350, 400, respectively) along with trendlines for each. Scenario 1 has the highest efficiency, followed by scenario 2, and then scenario 3. In some implementations, the computer system 180 determines the injection efficiency as the vertical gap between the $IPR_{cum}$ curve and the normalized pressure curve. For example, gaps 302, 354, 354, and 402 represent injection efficiency.

In some implementations, detailed production and injection data with improved accuracy and/or expanded pressure survey datasets covering a broader timeframe and spatial extent can be used to increase the accuracy of the material balance model. The material balance model provides accurate and reliable insights empowering confident decision-making to optimizing reservoir development strategy for external injection placement. The material balance model also supports projects including simulation studies and history matching processes. In some implementations, the computer system 180 solves the material balance model analytically using a spreadsheet computation (for example, using Microsoft Excel®).

Figure 9:
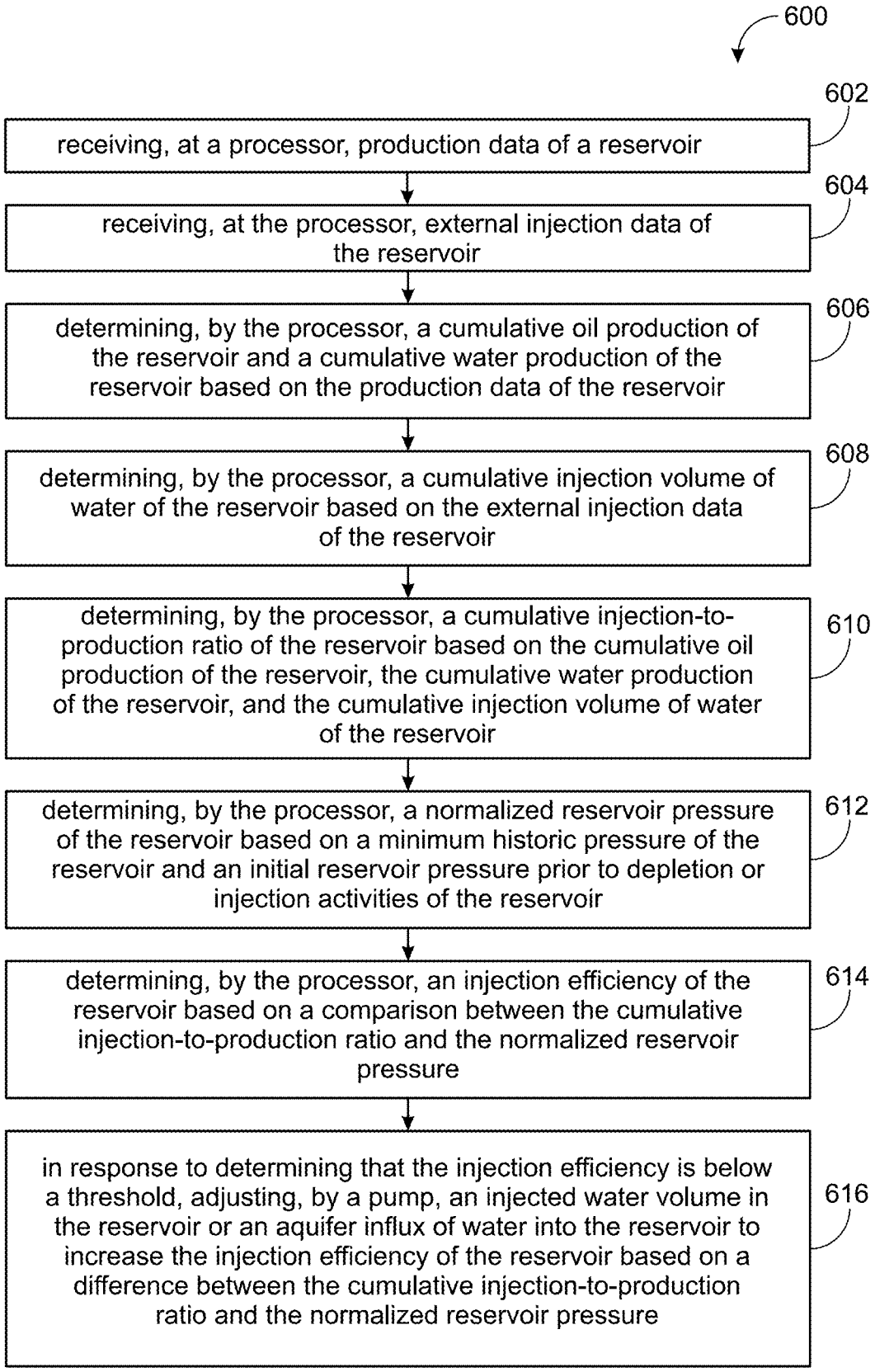
FIG. 9 is a flowchart of a method for recovering oil from a reservoir.

FIG. 9 is a flowchart of a method 600 for producing oil from a reservoir using a material balance model. In some implementations, one or more (for example, all) steps of the method 600 are performed by the computer system 180, which executes the material balance model. In some implementations, one or more steps of the method 900 are performed by a pump (for example, the pump 134 at the injection well 104 and/or the pump at the production well 102).

At step 602, the method includes receiving, at a processor, production data of a reservoir. For example, the processor of the computer system 180 receives production data of the reservoir 150 and uses the production data as input to the material balance model. In some examples, the production data includes oil and water volumes from the production well 102.

At step 604, the method includes receiving, at the processor, external injection data of the reservoir. For example, the processor of the computer system 180 receives external injection data of the reservoir 150 and uses the external injection data as input to the material balance model. In some examples, the external injection data includes injection volumes from the injection well 104.

At step 606, the method includes determining, by the processor, a cumulative oil production of the reservoir ($Qo_t$) and a cumulative water production ($Qw_t$) of the reservoir based on the production data of the reservoir. For example, the processor of the computer system 180 determines a cumulative oil production of the reservoir and a cumulative water production of the reservoir based on the production data of the reservoir 150. In some implementations, determining the cumulative oil production of the reservoir includes multiplying the oil volume at standard surface conditions by $B_o$, where $B_o$ represents the oil formation volume factor at initial reservoir pressure and temperature conditions. In some implementations, determining the cumulative water production of the reservoir includes defining the cumulative water production of the reservoir as $B_w$, where $B_w$ represents the water formation volume factor at initial reservoir pressure and temperature conditions.

At step 608, the method includes determining, by the processor, a cumulative injection volume of water ($Qinj_t$) of the reservoir based on the external injection data of the reservoir. For example, the processor of the computer system 180 determines the cumulative injection volume of water of the reservoir 150 based on the production data of the reservoir 150. In some implementations, determining the cumulative injection volume of water of the reservoir includes defining the cumulative injection volume of water of the reservoir as $B_w$, where $B_w$ represents the water formation volume factor at initial reservoir pressure and temperature conditions.

At step 610, the method includes determining, by the processor, a cumulative injection-to-production ratio ($IPR_{cum}$) of the reservoir based on the cumulative oil production of the reservoir, the cumulative water production of the reservoir, and the cumulative injection volume of water of the reservoir. For example, the processor of the computer system 180 determines the cumulative injection-to-production ratio based on the cumulative oil production of the reservoir 150, the cumulative water production of the reservoir 150, and the cumulative injection volume of water of the reservoir 150. In some implementations, the processor of the computer system 180 determines $IPR_{cum}$ by evaluating equation 2.

In some implementations, the cumulative injection-to-production ratio is indicative of (i) no injection when the cumulative injection-to-production ratio is zero, (ii) a complete replacement of produced fluids by injected water when the cumulative injection-to-production ratio is one, and (iii) the injected water exceeding a voidage replacement of the reservoir when the cumulative injection-to-production ratio is greater than one. In some implementations, the cumulative injection-to-production ratio is independent of oil compressibility effects of the reservoir.

At step 612, the method includes determining, by the processor, a normalized reservoir pressure of the reservoir based on a minimum historic pressure of the reservoir and an initial reservoir pressure prior to depletion or injection activities of the reservoir. For example, the processor of the computer system 180 determines the normalized reservoir pressure of the reservoir 150 based on a minimum historic pressure ($P_{lowest}$) of the reservoir 150 and an initial reservoir pressure ($P_{initial}$) prior to depletion or injection activities of the reservoir 150. In some implementations, the processor determines the normalized reservoir pressure by evaluating equation 3.

In some implementations, the normalized reservoir pressure is indicative of (i) a minimum pressure recorded during a lifetime of the reservoir when the normalized reservoir pressure is zero, (ii) a reestablishment of an initial pressure of the reservoir when the normalized reservoir pressure is one, and (iii) an overpressure of the reservoir due to a sustained injection of water when the normalized reservoir pressure is greater than one.

At step 614, the method includes determining, by the processor, an injection efficiency of the reservoir based on a comparison between the cumulative injection-to-production ratio and the normalized reservoir pressure. For example, the processor of the computer system 180 determines the injection efficiency based on a comparison between the cumulative injection-to-production ratio and the normalized reservoir pressure. In some implementations, the processor of the computer system 180 determines the injection efficiency as the vertical gap (for example, one or more of gaps 302, 352, 354, and 402) between the $IPR_{cum}$ curve and the normalized pressure curve. In some examples, the injection efficiency is determined by subtracting the $IPR_{cum}$ curve from the normalized pressure curve (for example, injection efficiency=$IPR_{cum}$−normalized pressure). In some implementations, the injection efficiency is determined as a function of time (for example, years). In some examples, the injection efficiency is determined over a history of the reservoir (for example, from year 1950 to the current year).

At step 616, the method includes in response to determining that the injection efficiency is below a threshold, adjusting, by a pump, an injected water volume in the reservoir or an aquifer influx of water into the reservoir to increase the injection efficiency of oil production from the reservoir based on a difference between the cumulative injection-to-production ratio and the normalized reservoir pressure. For example, the processor of the computer system 180 determines whether the injection efficiency is below a threshold based on the difference between the cumulative injection-to-production ratio and the normalized reservoir pressure. In some implementations, the threshold is between 0 and 1 (for example, between 0 and 0.5, or between 0 and 0.2). In some examples, the threshold is 0.2.

Then, in response to determining the injection efficiency is below the threshold, the processor of the computer system 180 can control the pump 132 of the injection well 104 to adjust the injected water volume in the reservoir 150 or an aquifer influx of water into the reservoir 150 to increase the injection efficiency of the reservoir 150. In some examples, in response to determining the injection efficiency is below the threshold, the processor of the computer system 180 instructs an operator of the injection well to adjust the injected water volume in the reservoir 150 or an aquifer influx of water into the reservoir 150 to increase the injection efficiency of the reservoir 150. Then, the operator can manually adjust the pumping pressure of the pump 132.

The systems and methods can be used to increase injection efficiency to 100%, where injection effectively supports production rates. Deviations from this target can indicate inefficiencies, for example, below 100% can indicate flux loss, including into the aquifer, suggesting inefficient injection, and above 100% can accelerate water breakthrough at producers, which is also not ideal. A tolerance can be introduced for example (+10%), depending on field-specific characteristics and performance. The systems and methods analyze dynamic data and identify areas for improvements. The systems and methods provide quantitative outputs that can inform injection strategy decisions, including optimizing patterns, distribution, and rates. This approach enables tailored management, considering each reservoir's unique characteristics, to achieve goals such as: ensuring reservoir health, meeting production targets, avoiding dead wells due to inefficient injection, and managing water breakthrough effectively.

In some implementations, adjusting the injected water volume in the reservoir or the aquifer influx of water into the reservoir to increase the injection efficiency of the reservoir includes: (i) determining a control signal for the pump based on the difference between the cumulative injection-to-production ratio and the normalized reservoir pressure, and (ii) controlling the pump based on the control signal to pump the injected water volume in the reservoir to increase the injection efficiency of the reservoir. For example, the processor of the computer system 180 determines a control signal for the pump 132, transmits the control signal to the pump 132 (for example by wired or wireless communication 182), and in response to receiving the control signal at the pump 132, the pump executes the control signal to adjust the injected water volume in the reservoir 150 or the aquifer influx of water into the reservoir 150 to increase the injection efficiency of the reservoir 150.

In some implementations, adjusting the injected water volume in the reservoir or the aquifer influx of water into the reservoir to increase the injection efficiency of the reservoir includes: (i) applying a scale factor to the cumulative injection-to-production ratio to result in the cumulative injection-to-production ratio substantially matching the normalized reservoir pressure; and (ii) controlling the pump based on the scale factor to increase the injection efficiency of the reservoir.

For example, the processor of the computer system 180 applies a scale factor to the cumulative injection-to-production ratio to result in the cumulative injection-to-production ratio substantially matching the normalized reservoir pressure using the history matching process described with reference to FIG. 7. In some implementations, the history matching process involves adding multipliers to the IPR curve through an iterative process until the history matched IPR becomes aligned with the normalized pressure curve. In some implementations, the injection efficiency can mathematically be defined by the equation:

$$\text{Injection Efficiency} = 100 * \left( \frac{IPR_{cum}(t) - P_n(t)}{IPR_{cum}(t)} \right)$$

where $IPR_{cum}(t)$ is the cumulative IPR for a given time, and $P_n(t)$ is the instantaneous normalized pressure for a given time.

In some implementations, the method includes after adjusting the injected water volume in the reservoir or the aquifer influx of water into the reservoir to increase the injection efficiency of the reservoir: (i) determining, by the processor (for example, of the computer system 180), an updated injection efficiency of the reservoir based on an updated comparison between an updated cumulative injection-to-production ratio and an updated normalized reservoir pressure; and (ii) in response to determining that the updated injection efficiency is below the threshold, further adjusting, by the pump (for example, pump 132), the injected water volume in the reservoir or the aquifer influx of water into the reservoir to further increase the injection efficiency of the reservoir based on an updated difference between the updated cumulative injection-to-production ratio and the updated normalized reservoir pressure.

In some implementations, the computer system 180 implements method 600 automatically without user input and continuously readjusts the pumping of the injected water at the pump 132 to continuously improve injection efficiencies of the production well 102.

Figure 10:
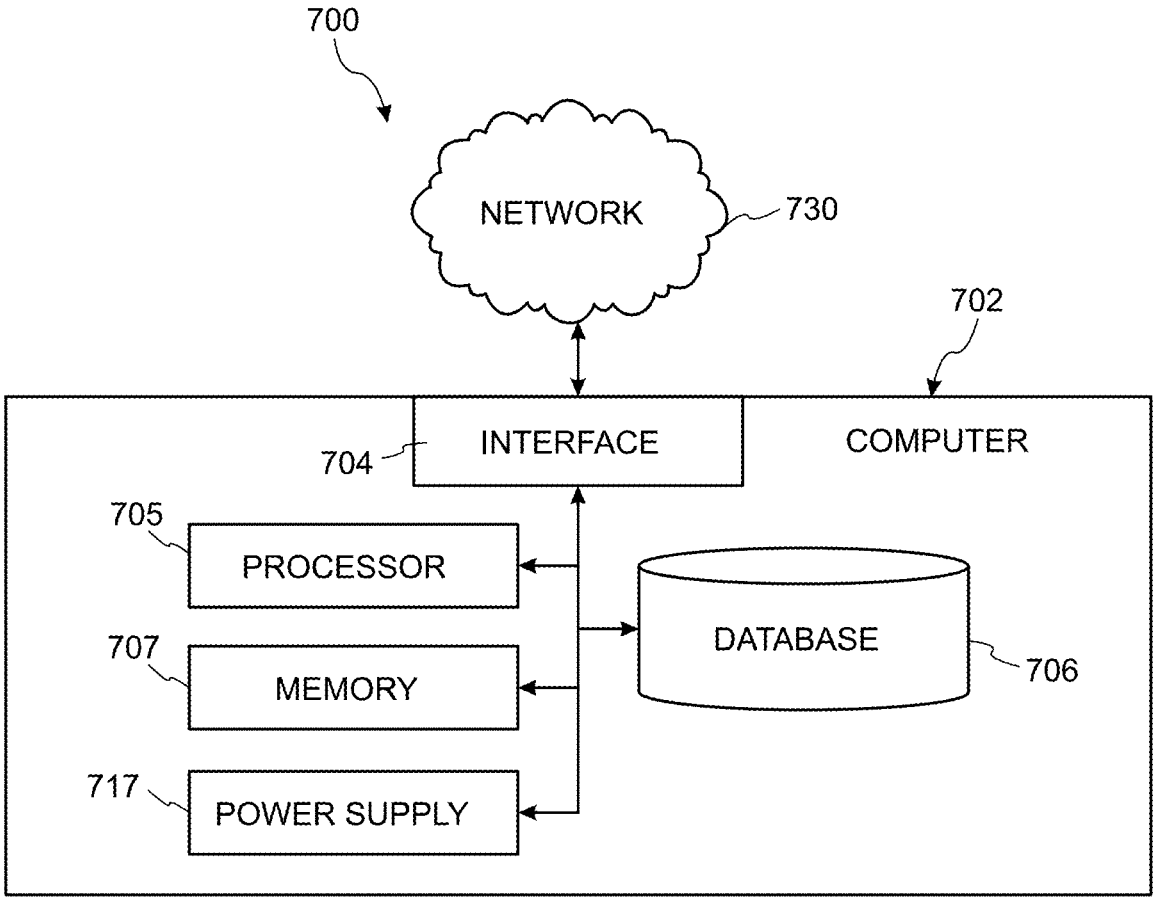
FIG. 10 is a schematic of a controller for determining an injection efficiency of the reservoir and for controlling a pump to recover oil from the reservoir.

FIG. 10 is a block diagram of a computer system 700 that can be used to provide computational functionalities associated with described algorithms, methods, functions, processes, flows, and procedures described in the present disclosure. In some implementations, the computer system 700 performs one or more steps of the method 600. In some examples, the computer system 700 performs and/or controls all steps of the method 600.

The illustrated computer 702 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 702 can include input devices such as keypads, keyboards, and touch screens that can accept user information. Also, the computer 702 can include output devices that can convey information associated with the operation of the computer 702. The information can include digital data, visual data, audio information, or a combination of information. The information can be presented in a graphical user interface (UI) (or GUI). In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 702 can include a Smart Embedded Management Agent (SEMA), such as a built-in ADLINK SEMA 2.2, and a video sync technology, such as Quick Sync Video technology supported by ADLINK MSDK+. In some examples, the computer 1702 can include the MXE-5400 Series processor-based fanless embedded computer by ADLINK, though the computer 702 can take other forms or include other components.

The computer 702 can serve in a role as a client, a network component, a server, a database, a persistency, or components of a computer system for performing the subject matter described in the present disclosure. The illustrated computer 702 is communicably coupled with a network 730. In some implementations, one or more components of the computer 702 can be configured to operate within different environments, including cloud-computing-based environments, local environments, global environments, and combinations of environments.

At a high level, the computer 702 is an electronic computing device operable to receive, transmit, process, store, and manage data and information associated with the described subject matter. According to some implementations, the computer 702 can also include, or be communicably coupled with, an application server, an email server, a web server, a caching server, a streaming data server, or a combination of servers.

The computer 702 can receive requests over network 730 from a client application (for example, executing on another computer 702). The computer 702 can respond to the received requests by processing the received requests using software applications. Requests can also be sent to the computer 702 from internal users (for example, from a command console), external (or third) parties, automated applications, entities, individuals, systems, and computers.

Each of the components of the computer 702 can communicate using a system bus. In some implementations, any or all of the components of the computer 702, including hardware or software components, can interface with each other or the interface 704 (or a combination of both), over the system bus. Interfaces can use an application programming interface (API), a service layer, or a combination of the API and service layer. The API can include specifications for routines, data structures, and object classes. The API can be either computer-language independent or dependent. The API can refer to a complete interface, a single function, or a set of APIs.

The service layer can provide software services to the computer 702 and other components (whether illustrated or not) that are communicably coupled to the computer 702. The functionality of the computer 702 can be accessible for all service consumers using this service layer. Software services, such as those provided by the service layer, can provide reusable, defined functionalities through a defined interface. For example, the interface can be software written in JAVA, C++, or a language providing data in extensible markup language (XML) format. While illustrated as an integrated component of the computer 702, in alternative implementations, the API or the service layer can be standalone components in relation to other components of the computer 702 and other components communicably coupled to the computer 702. Moreover, any or all parts of the API or the service layer can be implemented as child or submodules of another software module, enterprise application, or hardware module without departing from the scope of the present disclosure.

The computer 702 can include an interface 704. Although illustrated as a single interface 704, two or more interfaces 704 can be used according to particular needs, desires, or particular implementations of the computer 702 and the described functionality. The interface 704 can be used by the computer 702 for communicating with other systems that are connected to the network 730 (whether illustrated or not) in a distributed environment. Generally, the interface 704 can include, or be implemented using, logic encoded in software or hardware (or a combination of software and hardware) operable to communicate with the network 730. More specifically, the interface 704 can include software supporting one or more communication protocols associated with communications. As such, the network 730 or the interface's hardware can be operable to communicate physical signals within and outside of the illustrated computer 702.

The computer 702 includes a processor 705. Although illustrated as a single processor 705, two or more processors 705 can be used according to particular needs, desires, or particular implementations of the computer 702 and the described functionality. Generally, the processor 705 can execute instructions and can manipulate data to perform the operations of the computer 702, including operations using algorithms, methods, functions, processes, flows, and procedures as described in the present disclosure. For example, the processor 705 includes or is the processor described with reference to method 600. For example, the processor 705 can execute the material balance model, receive production data and external injection data of a reservoir (steps 602, 604), determine the cumulative oil production of the reservoir (step 606), determine the cumulative injection volume of water of the reservoir (step 608), determine the cumulative injection-to-production ratio of the reservoir (step 610), determine the normalized reservoir pressure of the reservoir (step 612), determine the injection efficiency of the reservoir (step 614), and control the pump to adjust the injected water volume of the reservoir or the aquifer influx of water into the reservoir (step 616).

The computer 702 can also include a database 706 that can hold data for the computer 702 and other components connected to the network 730 (whether illustrated or not). For example, database 706 can be an in-memory, conventional, or a database storing data consistent with the present disclosure. In some implementations, database 706 can be a combination of two or more different database types (for example, hybrid in-memory and conventional databases) according to particular needs, desires, or particular implementations of the computer 702 and the described functionality. Although illustrated as a single database 706 two or more databases (of the same, different, or combination of types) can be used according to particular needs, desires, or particular implementations of the computer 702 and the described functionality. For example, the database 706 can store the production data of the reservoir, the external injection data of the wellbore, determined cumulative oil production values, determined cumulative injection volumes of water, determined cumulative injection-to-production ratios, determined normalized reservoir pressures, determined injection efficiencies, and historical results (for example, injection efficiencies over time, changes in injection efficiency due to a control loop in which the processor controls the pump to adjust the injected water volume in the reservoir, remeasure the injection efficiency, adjusts the control of the pump to readjust the injected water volume in the reservoir, and so on). While database 706 is illustrated as an internal component of the computer 702, in alternative implementations, database 706 can be external to the computer 702.

The computer 702 also includes a memory 707 that can hold data for the computer 702 or a combination of components connected to the network 730 (whether illustrated or not). Memory 707 can store any data consistent with the present disclosure. In some implementations, memory 707 can be a combination of two or more different types of memory (for example, a combination of semiconductor and magnetic storage) according to particular needs, desires, or particular implementations of the computer 702 and the described functionality. Although illustrated as a single memory 707, two or more memories 707 (of the same, different, or combination of types) can be used according to particular needs, desires, or particular implementations of the computer 702 and the described functionality. While memory 707 is illustrated as an internal component of the computer 702, in alternative implementations, memory 1007 can be external to the computer 702.

An application can be an algorithmic software engine providing functionality according to particular needs, desires, or particular implementations of the computer 702 and the described functionality. For example, an application can serve as one or more components, modules, or applications. Multiple applications can be implemented on the computer 702. Each application can be internal or external to the computer 702.

The computer 702 can also include a power supply 714. The power supply 714 can include a rechargeable or non-rechargeable battery that can be configured to be either user- or non-user-replaceable. In some implementations, the power supply 714 can include power-conversion and management circuits, including recharging, standby, and power management functionalities. In some implementations, the power-supply 714 can include a power plug to allow the computer 702 to be plugged into a wall socket or a power source to, for example, power the computer 702 or recharge a rechargeable battery.

There can be any number of computers 702 associated with, or external to, a computer system including computer 702, with each computer 702 communicating over network 1030. Further, the terms "client," "user," and other appropriate terminology can be used interchangeably, as appropriate, without departing from the scope of the present disclosure. Moreover, the present disclosure contemplates that many users can use one computer 702 and one user can use multiple computers 702.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

EXAMPLES

Certain aspects of the subject matter described here can be implemented as a method of producing oil from a reservoir. The method includes receiving, at a processor, production data of the reservoir. The method includes receiving, at the processor, external injection data of the reservoir. The method includes determining, by the processor, a cumulative oil production of the reservoir and a cumulative water production of the reservoir based on the production data of the reservoir. The method includes determining, by the processor, a cumulative injection volume of water of the reservoir based on the external injection data of the reservoir. The method includes determining, by the processor, a cumulative injection-to-production ratio of the reservoir based on the cumulative oil production of the reservoir, the cumulative water production of the reservoir, and the cumulative injection volume of water of the reservoir. The cumulative injection-to-production ratio is indicative of (i) no injection when the cumulative injection-to-production ratio is zero, (ii) a complete replacement of produced fluids by injected water when the cumulative injection-to-production ratio is one, and (iii) the injected water exceeding a voidage replacement of the reservoir when the cumulative injection-to-production ratio is greater than one. The method includes determining, by the processor, a normalized reservoir pressure of the reservoir based on a minimum historic pressure of the reservoir and an initial reservoir pressure prior to depletion or injection activities of the reservoir. The normalized reservoir pressure is indicative of (i) a minimum pressure recorded during a lifetime of the reservoir when the normalized reservoir pressure is zero, (ii) a reestablishment of an initial pressure of the reservoir when the normalized reservoir pressure is one, and (iii) an overpressure of the reservoir due to a sustained injection of water when the normalized reservoir pressure is greater than one. The method includes determining, by the processor, an injection efficiency of the reservoir based on a comparison between the cumulative injection-to-production ratio and the normalized reservoir pressure. The method includes in response to determining that the injection efficiency is below a threshold, adjusting, by a pump, an injected water volume in the reservoir or an aquifer influx of water into the reservoir to increase the injection efficiency of oil production from the reservoir based on a difference between the cumulative injection-to-production ratio and the normalized reservoir pressure.

An aspect combinable with any other aspect can include the following features.

In an example implementation (or aspect) combinable with any other example implementation (or aspect), the cumulative injection-to-production ratio is determined by evaluating the following equation:

$$IPR_{cum} = \frac{Qinj_t \times B_w}{(Qo_t \times B_O) + [\![(Qw]\!]_t \times B_w)}$$

where $IPR_{cum}$ is the cumulative injection-to-production ratio, Qinjt is the cumulative injection volume of water of the reservoir, Qot is the cumulative oil production of the reservoir, Qwt is a the cumulative water production of the reservoir, $B_o$ is an oil formation volume factor at the initial reservoir pressure of the reservoir, and $B_w$ is a water formation volume factor at the initial reservoir pressure of the reservoir.

In an example implementation (or aspect) combinable with any other example implementation (or aspect), the normalized reservoir pressure is determined by evaluating the following equation:

$$\text{Normalized Pressure} = \frac{P_t - P_{lowest}}{P_{initial} - P_{lowest}}$$

where Normalized Pressure is the normalized reservoir pressure, $P_t$ is a variable pressure of the reservoir as a function of time, $P_{lowest}$ is the minimum historic pressure of the reservoir, and $P_{initial}$ is the initial reservoir pressure prior to the depletion or injection activities of the reservoir.

In an example implementation (or aspect) combinable with any other example implementation (or aspect), adjusting the injected water volume in the reservoir or the aquifer influx of water into the reservoir to increase the injection efficiency of the reservoir includes determining a control signal for the pump based on the difference between the cumulative injection-to-production ratio and the normalized reservoir pressure, and controlling the pump based on the control signal to pump the injected water volume in the reservoir to increase the injection efficiency of the reservoir.

In an example implementation (or aspect) combinable with any other example implementation (or aspect), adjusting the injected water volume in the reservoir or the aquifer influx of water into the reservoir to increase the injection efficiency of the reservoir includes applying a scale factor to the cumulative injection-to-production ratio to result in the cumulative injection-to-production ratio substantially matching the normalized reservoir pressure; and controlling the pump based on the scale factor to increase the injection efficiency of the reservoir.

In an example implementation (or aspect) combinable with any other example implementation (or aspect), the method includes, after adjusting the injected water volume in the reservoir or the aquifer influx of water into the reservoir to increase the injection efficiency of the reservoir: determining, by the processor, an updated injection efficiency of the reservoir based on an updated comparison between an updated cumulative injection-to-production ratio and an updated normalized reservoir pressure; and in response to determining that the updated injection efficiency is below the threshold, further adjusting, by the pump, the injected water volume in the reservoir or the aquifer influx of water into the reservoir to further increase the injection efficiency of the reservoir based on an updated difference between the updated cumulative injection-to-production ratio and the updated normalized reservoir pressure.

In an example implementation (or aspect) combinable with any other example implementation (or aspect), the cumulative injection-to-production ratio is independent of oil compressibility effects of the reservoir.

Certain aspects of the subject matter described here can be implemented as a method of producing oil from a reservoir. The method includes receiving, at a processor, production data of the reservoir. The method includes receiving, at the processor, external injection data of the reservoir. The method includes determining, by the processor, a cumulative oil production of the reservoir and a cumulative water production of the reservoir based on the production data of the reservoir. The method includes determining, by the processor, a cumulative injection volume of water of the reservoir based on the external injection data of the reservoir. The method includes determining, by the processor, a cumulative injection-to-production ratio of the reservoir based on the cumulative oil production of the reservoir, the cumulative water production of the reservoir, and the cumulative injection volume of water of the reservoir. The method includes determining, by the processor, a normalized reservoir pressure of the reservoir based on a minimum historic pressure of the reservoir and an initial reservoir pressure prior to depletion or injection activities of the reservoir. The method includes determining, by the processor, an injection efficiency of the reservoir based on a comparison between the cumulative injection-to-production ratio and the normalized reservoir pressure. The method includes in response to determining that the injection efficiency is below a threshold, adjusting, by a pump, an injected water volume in the reservoir or an aquifer influx of water into the reservoir to increase the injection efficiency of oil production from the reservoir based on a difference between the cumulative injection-to-production ratio and the normalized reservoir pressure.

An aspect combinable with any other aspect can include the following features.

In an example implementation (or aspect) combinable with any other example implementation (or aspect), adjusting the injected water volume in the reservoir or the aquifer influx of water into the reservoir to increase the injection efficiency of the reservoir includes applying a scale factor to the cumulative injection-to-production ratio to result in the cumulative injection-to-production ratio substantially matching the normalized reservoir pressure.

In an example implementation (or aspect) combinable with any other example implementation (or aspect), the cumulative injection-to-production ratio is indicative of (i) no injection when the cumulative injection-to-production ratio is zero, (ii) a complete replacement of produced fluids by injected water when the cumulative injection-to-production ratio is one, and (iii) the injected water exceeding a voidage replacement of the reservoir when the cumulative injection-to-production ratio is greater than one.

In an example implementation (or aspect) combinable with any other example implementation (or aspect), the normalized reservoir pressure is indicative of (i) a minimum pressure recorded during a lifetime of the reservoir when the normalized reservoir pressure is zero, (ii) a reestablishment of an initial pressure of the reservoir when the normalized reservoir pressure is one, and (iii) an overpressure of the reservoir due to a sustained injection of water when the normalized reservoir pressure is greater than one.

In an example implementation (or aspect) combinable with any other example implementation (or aspect), the cumulative injection-to-production ratio is determined by evaluating the following equation:

$$IPR_{cum} = \frac{Qinj_t \times B_w}{(Qo_t \times B_O) + [\![(Qw]\!]_t \times B_w)}$$

where $IPR_{cum}$ is the cumulative injection-to-production ratio, $Qinj_t$ is the cumulative injection volume of water of the reservoir, $Qo_t$ is the cumulative oil production of the reservoir, $Qw_t$ is a the cumulative water production of the reservoir, $B_o$ is an oil formation volume factor at the initial reservoir pressure of the reservoir, and $B_w$ is a water formation volume factor at the initial reservoir pressure of the reservoir.

In an example implementation (or aspect) combinable with any other example implementation (or aspect), the normalized reservoir pressure is determined by evaluating the following equation:

$$\text{Normalized Pressure} = \frac{P_t - P_{lowest}}{P_{initial} - P_{lowest}}$$

where Normalized Pressure is the normalized reservoir pressure, $P_t$ is a variable pressure of the reservoir as a function of time, $P_{lowest}$ is the minimum historic pressure of the reservoir, and $P_{initial}$ is the initial reservoir pressure prior to the depletion or injection activities of the reservoir.

In an example implementation (or aspect) combinable with any other example implementation (or aspect), adjusting the injected fluid volume in the reservoir or the aquifer influx of water into the reservoir to increase the injection efficiency of the reservoir includes: determining a control signal for the pump based on the difference between the cumulative injection-to-production ratio and the normalized reservoir pressure, and controlling the pump based on the control signal to pump the injected water volume in the reservoir to increase the injection efficiency of the reservoir.

In an example implementation (or aspect) combinable with any other example implementation (or aspect), determining the control signal for the pump includes applying a scale factor to the cumulative injection-to-production ratio to result in the cumulative injection-to-production ratio substantially matching the normalized reservoir pressure; and determining the control signal the pump based on the scale factor.

In an example implementation (or aspect) combinable with any other example implementation (or aspect), the method includes, after adjusting the injected water volume in the reservoir or the aquifer influx of water into the reservoir to increase the injection efficiency of the reservoir: determining, by the processor, an updated injection efficiency of the reservoir based on an updated comparison between an updated cumulative injection-to-production ratio and an updated normalized reservoir pressure; and in response to determining that the updated injection efficiency is below the threshold, further adjusting, by the pump, the injected water volume in the reservoir or the aquifer influx of water into the reservoir to further increase the injection efficiency of the reservoir based on an updated difference between the updated cumulative injection-to-production ratio and the updated normalized reservoir pressure.

Certain aspects of the subject matter described here can be implemented as a method of producing oil from a reservoir. The method includes receiving, at a processor, production data of oil production and injection data of the reservoir. The method includes determining, by the processor, a cumulative oil production of the reservoir and a cumulative water production of the reservoir based on the production data of the reservoir. The method includes determining, by the processor, a cumulative injection volume of water based on the injection data of the reservoir. The method includes determining, by the processor, a cumulative injection-to-production ratio of the reservoir based on at least one of the cumulative oil production of the reservoir, the cumulative water production of the reservoir, or the cumulative injection volume of water of the reservoir. The method includes determining, by the processor, a normalized reservoir pressure of the reservoir based on at least one of a minimum historic pressure of the reservoir and an initial reservoir pressure prior to depletion or injection activities of the reservoir. The method includes determining, by the processor, an injection efficiency of the reservoir based on a comparison between the cumulative injection-to-production ratio and the normalized reservoir pressure. The method includes in response to determining that the injection efficiency is below a threshold, adjusting, by a pump, an injected fluid volume in the reservoir or an aquifer influx of water into the reservoir to increase the injection efficiency of oil production from the reservoir based on a difference between the cumulative injection-to-production ratio and the normalized reservoir pressure.

An aspect combinable with any other aspect can include the following features.

In an example implementation (or aspect) combinable with any other example implementation (or aspect), adjusting the injected fluid volume in the reservoir or the aquifer influx of water into the reservoir to increase the injection efficiency of the reservoir includes: determining a control signal for the pump based on the difference between the cumulative injection-to-production ratio and the normalized reservoir pressure, and controlling the pump based on the control signal to pump the injected fluid volume in the reservoir to increase the injection efficiency of the reservoir.

In an example implementation (or aspect) combinable with any other example implementation (or aspect), adjusting the injected fluid volume in the reservoir or the aquifer influx of water into the reservoir to increase the injection efficiency of the reservoir includes: applying a scale factor to the cumulative injection-to-production ratio to result in the cumulative injection-to-production ratio substantially matching the normalized reservoir pressure; and controlling the pump based on the scale factor to increase the injection efficiency of the reservoir. In an example implementation (or aspect) combinable with any other example implementation (or aspect), the method includes, after adjusting the injected fluid volume in the reservoir or the aquifer influx of water into the reservoir to increase the injection efficiency of the reservoir: determining, by the processor, an updated injection efficiency of the reservoir based on an updated comparison between an updated cumulative injection-to-production ratio and an updated normalized reservoir pressure; and in response to determining that the updated injection efficiency is below the threshold, further adjusting, by the pump, the injected fluid volume in the reservoir or the aquifer influx of water into the reservoir to further increase the injection efficiency of the reservoir based on an updated difference between the updated cumulative injection-to-production ratio and the updated normalized reservoir pressure.

A number of implementations of the systems and methods have been described. Nevertheless, it will be understood that various modifications may be made without departing from the spirit and scope of this disclosure. Accordingly, other implementations are within the scope of the following claims.

What is claimed is:

1. A method of producing oil from a reservoir, the method comprising:

receiving, at a processor, production data of the reservoir;

receiving, at the processor, external injection data of the reservoir;

determining, by the processor, a cumulative oil production of the reservoir and a cumulative water production of the reservoir based on the production data of the reservoir;

determining, by the processor, a cumulative injection volume of water of the reservoir based on the external injection data of the reservoir;

determining, by the processor, a cumulative injection-to-production ratio of the reservoir based on the cumulative oil production of the reservoir, the cumulative water production of the reservoir, and the cumulative injection volume of water of the reservoir, wherein the cumulative injection-to-production ratio is indicative of (i) no injection when the cumulative injection-to-production ratio is zero, (ii) a complete replacement of produced fluids by injected water when the cumulative injection-to-production ratio is one, and (iii) the injected water exceeding a voidage replacement of the reservoir when the cumulative injection-to-production ratio is greater than one;

determining, by the processor, a normalized reservoir pressure of the reservoir based on a minimum historic pressure of the reservoir and an initial reservoir pressure prior to depletion or injection activities of the reservoir, wherein the normalized reservoir pressure is indicative of (i) a minimum pressure recorded during a lifetime of the reservoir when the normalized reservoir pressure is zero, (ii) a reestablishment of an initial pressure of the reservoir when the normalized reservoir pressure is one, and (iii) an overpressure of the reservoir due to a sustained injection of water when the normalized reservoir pressure is greater than one;

determining, by the processor, an injection efficiency of the reservoir based on a comparison between the cumulative injection-to-production ratio and the normalized reservoir pressure; and in response to determining that the injection efficiency is below a threshold, adjusting, by a pump, an injected water volume in the reservoir or an aquifer influx of water into the reservoir to increase the injection efficiency of oil production from the reservoir based on a difference between the cumulative injection-to-production ratio and the normalized reservoir pressure.

2. The method of claim 1, wherein the cumulative injection-to-production ratio is determined by evaluating the following equation:

$$IPR_{cum} = \frac{Qinj_t \times B_w}{(Qo_t \times B_O) + [\![(Qw]\!]_t \times B_w)}$$

where $IPR_{cum}$ is the cumulative injection-to-production ratio, Qinjt is the cumulative injection volume of water of the reservoir, Qot is the cumulative oil production of the reservoir, Qwt is a the cumulative water production of the reservoir, $B_o$ is an oil formation volume factor at the initial reservoir pressure of the reservoir, and $B_w$ is a water formation volume factor at the initial reservoir pressure of the reservoir.

3. The method of claim 1, wherein the normalized reservoir pressure is determined by evaluating the following equation:

$$\text{Normalized Pressure} = \frac{P_t - P_{lowest}}{P_{initial} - P_{lowest}}$$

where Normalized Pressure is the normalized reservoir pressure, $P_t$ is a variable pressure of the reservoir as a function of time, $P_{lowest}$ is the minimum historic pressure of the reservoir, and $P_{initial}$ is the initial reservoir pressure prior to the depletion or injection activities of the reservoir.

4. The method of claim 1, wherein adjusting the injected water volume in the reservoir or the aquifer influx of water into the reservoir to increase the injection efficiency of the reservoir comprises:

determining a control signal for the pump based on the difference between the cumulative injection-to-production ratio and the normalized reservoir pressure, and controlling the pump based on the control signal to pump the injected water volume in the reservoir to increase the injection efficiency of the reservoir.

5. The method of claim 1, wherein adjusting the injected water volume in the reservoir or the aquifer influx of water into the reservoir to increase the injection efficiency of the reservoir comprises:

applying a scale factor to the cumulative injection-to-production ratio to result in the cumulative injection-to-production ratio substantially matching the normalized reservoir pressure; and controlling the pump based on the scale factor to increase the injection efficiency of the reservoir.

6. The method of claim 1, comprising, after adjusting the injected water volume in the reservoir or the aquifer influx of water into the reservoir to increase the injection efficiency of the reservoir:

determining, by the processor, an updated injection efficiency of the reservoir based on an updated comparison between an updated cumulative injection-to-production ratio and an updated normalized reservoir pressure; and in response to determining that the updated injection efficiency is below the threshold, further adjusting, by the pump, the injected water volume in the reservoir or the aquifer influx of water into the reservoir to further increase the injection efficiency of the reservoir based on an updated difference between the updated cumulative injection-to-production ratio and the updated normalized reservoir pressure.

7. The method of claim 1, wherein the cumulative injection-to-production ratio is independent of oil compressibility effects of the reservoir.

8. A method of producing oil from a reservoir, the method comprising:

receiving, at a processor, production data of the reservoir;

receiving, at the processor, external injection data of the reservoir;

determining, by the processor, a cumulative oil production of the reservoir and a cumulative water production of the reservoir based on the production data of the reservoir;

determining, by the processor, a cumulative injection volume of water of the reservoir based on the external injection data of the reservoir;

determining, by the processor, a cumulative injection-to-production ratio of the reservoir based on the cumulative oil production of the reservoir, the cumulative water production of the reservoir, and the cumulative injection volume of water of the reservoir;

determining, by the processor, a normalized reservoir pressure of the reservoir based on a minimum historic pressure of the reservoir and an initial reservoir pressure prior to depletion or injection activities of the reservoir;

determining, by the processor, an injection efficiency of the reservoir based on a comparison between the cumulative injection-to-production ratio and the normalized reservoir pressure; and in response to determining that the injection efficiency is below a threshold, adjusting, by a pump, an injected water volume in the reservoir or an aquifer influx of water into the reservoir to increase the injection efficiency of oil production from the reservoir based on a difference between the cumulative injection-to-production ratio and the normalized reservoir pressure.

9. The method of claim 8, wherein adjusting the injected water volume in the reservoir or the aquifer influx of water into the reservoir to increase the injection efficiency of the reservoir comprises applying a scale factor to the cumulative injection-to-production ratio to result in the cumulative injection-to-production ratio substantially matching the normalized reservoir pressure.

10. The method of claim 8, wherein the cumulative injection-to-production ratio is indicative of (i) no injection when the cumulative injection-to-production ratio is zero, (ii) a complete replacement of produced fluids by injected water when the cumulative injection-to-production ratio is one, and (iii) the injected water exceeding a voidage replacement of the reservoir when the cumulative injection-to-production ratio is greater than one.

11. The method of claim 8, wherein the normalized reservoir pressure is indicative of (i) a minimum pressure recorded during a lifetime of the reservoir when the normalized reservoir pressure is zero, (ii) a reestablishment of an initial pressure of the reservoir when the normalized reservoir pressure is one, and (iii) an overpressure of the reservoir due to a sustained injection of water when the normalized reservoir pressure is greater than one.

12. The method of claim 8, wherein the cumulative injection-to-production ratio is determined by evaluating the following equation:

$$IPR_{cum} = \frac{Qinj_t \times B_w}{(Qo_t \times B_O) + [\![(Qw]\!]_t \times B_w)}$$

where $IPR_{cum}$ is the cumulative injection-to-production ratio, $Qinj_t$ is the cumulative injection volume of water of the reservoir, $Qo_t$ is the cumulative oil production of the reservoir, $Qw_t$ is a the cumulative water production of the reservoir, $B_o$ is an oil formation volume factor at the initial reservoir pressure of the reservoir, and $B_w$ is a water formation volume factor at the initial reservoir pressure of the reservoir.

13. The method of claim 8, wherein the normalized reservoir pressure is determined by evaluating the following equation:

$$\text{Normalized Pressure} = \frac{P_t - P_{lowest}}{P_{initial} - P_{lowest}}$$

where Normalized Pressure is the normalized reservoir pressure, $P_t$ is a variable pressure of the reservoir as a function of time, $P_{lowest}$ is the minimum historic pressure of the reservoir, and $P_{initial}$ is the initial reservoir pressure prior to the depletion or injection activities of the reservoir.

14. The method of claim 8, wherein adjusting the injected fluid volume in the reservoir or the aquifer influx of water into the reservoir to increase the injection efficiency of the reservoir comprises:

determining a control signal for the pump based on the difference between the cumulative injection-to-production ratio and the normalized reservoir pressure, and controlling the pump based on the control signal to pump the injected water volume in the reservoir to increase the injection efficiency of the reservoir.

15. The method of claim 14, wherein determining the control signal for the pump comprises:

applying a scale factor to the cumulative injection-to-production ratio to result in the cumulative injection-to-production ratio substantially matching the normalized reservoir pressure; and determining the control signal the pump based on the scale factor.

16. The method of claim 8, comprising, after adjusting the injected water volume in the reservoir or the aquifer influx of water into the reservoir to increase the injection efficiency of the reservoir:

determining, by the processor, an updated injection efficiency of the reservoir based on an updated comparison between an updated cumulative injection-to-production ratio and an updated normalized reservoir pressure; and in response to determining that the updated injection efficiency is below the threshold, further adjusting, by the pump, the injected water volume in the reservoir or the aquifer influx of water into the reservoir to further increase the injection efficiency of the reservoir based on an updated difference between the updated cumulative injection-to-production ratio and the updated normalized reservoir pressure.

17. A method of producing oil from a reservoir, the method comprising:

receiving, at a processor, production data of oil production and injection data of the reservoir;

determining, by the processor, a cumulative oil production of the reservoir and a cumulative water production of the reservoir based on the production data of the reservoir;

determining, by the processor, a cumulative injection volume of water based on the injection data of the reservoir;

determining, by the processor, a cumulative injection-to-production ratio of the reservoir based on at least one of the cumulative oil production of the reservoir, the cumulative water production of the reservoir, or the cumulative injection volume of water of the reservoir;

determining, by the processor, a normalized reservoir pressure of the reservoir based on at least one of a minimum historic pressure of the reservoir and an initial reservoir pressure prior to depletion or injection activities of the reservoir;

determining, by the processor, an injection efficiency of the reservoir based on a comparison between the cumulative injection-to-production ratio and the normalized reservoir pressure; and in response to determining that the injection efficiency is below a threshold, adjusting, by a pump, an injected fluid volume in the reservoir or an aquifer influx of water into the reservoir to increase the injection efficiency of oil production from the reservoir based on a difference between the cumulative injection-to-production ratio and the normalized reservoir pressure.

18. The method of claim 17, wherein adjusting the injected fluid volume in the reservoir or the aquifer influx of water into the reservoir to increase the injection efficiency of the reservoir comprises:

determining a control signal for the pump based on the difference between the cumulative injection-to-production ratio and the normalized reservoir pressure, and controlling the pump based on the control signal to pump the injected fluid volume in the reservoir to increase the injection efficiency of the reservoir.

19. The method of claim 17, wherein adjusting the injected fluid volume in the reservoir or the aquifer influx of water into the reservoir to increase the injection efficiency of the reservoir comprises:

applying a scale factor to the cumulative injection-to-production ratio to result in the cumulative injection-to-production ratio substantially matching the normalized reservoir pressure; and controlling the pump based on the scale factor to increase the injection efficiency of the reservoir.

20. The method of claim 17, comprising, after adjusting the injected fluid volume in the reservoir or the aquifer influx of water into the reservoir to increase the injection efficiency of the reservoir:

determining, by the processor, an updated injection efficiency of the reservoir based on an updated comparison between an updated cumulative injection-to-production ratio and an updated normalized reservoir pressure; and in response to determining that the updated injection efficiency is below the threshold, further adjusting, by the pump, the injected fluid volume in the reservoir or the aquifer influx of water into the reservoir to further increase the injection efficiency of the reservoir based on an updated difference between the updated cumulative injection-to-production ratio and the updated normalized reservoir pressure.

* * * * *